US007472792B2

(12) United States Patent
Browder

(10) Patent No.: US 7,472,792 B2
(45) Date of Patent: Jan. 6, 2009

(54) HIGH-VISIBILITY PRODUCT AND PACKAGE SYSTEM

(75) Inventor: John H. Browder, Roanoke, TX (US)

(73) Assignee: International Development Corporation, Roanoke, TX (US)

( * ) Notice: Subject to any disclaimer, the term of this patent is extended or adjusted under 35 U.S.C. 154(b) by 427 days.

(21) Appl. No.: 11/242,709

(22) Filed: Oct. 4, 2005

(65) Prior Publication Data

US 2006/0076259 A1 Apr. 13, 2006

Related U.S. Application Data

(60) Provisional application No. 60/616,078, filed on Oct. 4, 2004.

(51) Int. Cl.
*B65D 73/00* (2006.01)

(52) U.S. Cl. ..... 206/471; 206/461; 206/486; 206/503

(58) Field of Classification Search ..... 206/3, 206/372–379, 461–471, 503, 486
See application file for complete search history.

(56) References Cited

U.S. PATENT DOCUMENTS

| | | | | |
|---|---|---|---|---|
| 3,184,059 | A * | 5/1965 | Kaplan | 206/419 |
| 6,357,892 | B1 * | 3/2002 | Beadle | 362/267 |
| 2004/0149604 | A1 * | 8/2004 | Humphrey | 206/320 |

* cited by examiner

*Primary Examiner*—Taghi T. Arani
*Assistant Examiner*—Jose S Stephens, III
(74) *Attorney, Agent, or Firm*—David W. Carstens; Carstens & Cahoon, LLP

(57) ABSTRACT

A product packaging system includes an upper package shell formed around a product. Underneath the package shell is a product accessory pack. Beneath the upper package shell is a lower package shell for around the product accessory pack.

20 Claims, 6 Drawing Sheets

HIGH-VISIBILITY PRODUCT AND PACKAGE SYSTEM

This application claims the benefit of Provisional U.S. Patent Application No. 60/616,078, filed Oct. 4, 2004.

FIELD

The present invention relates to packaging, in general; more specifically the present invention relates to a system for securing and protecting a product while both providing for visibility of the product and facilitating secure stacking of the packages containing product ready at the point of sale.

BACKGROUND

Numerous packaging concepts are known in the prior art for displaying a wide variety of products in many different ways. The choice of a packaging concept depends greatly upon the way the packaged product is to be presented to the consumer in retail stores. Accordingly, many consumer articles are conventionally packaged and sold in packages known as "blister packs." Blister packs allow the consumer to visually examine a packaged product before making a purchase.

Conventionally, a blister pack includes a card, usually formed of medium to heavy gauge cardboard. The card is secured to a piece of clear plastic which is formed to include a pocket or blister which projects outwardly from the plane of the card on one side of the card. Generally, the card from which the blister projects extends beyond the edge of the blister in length, width, or both, to provide space on which appropriate graphics and text can be printed. The graphics or text are used to draw a consumer's attention to the product in addition to describing the use of the product and its special features.

The blister portion of the blister pack can contain a single product item, such as a single cosmetic item, or the blister portion can contain multiple spaces for a plurality of items, such as screws, nails, thumbtacks, and other such items conventionally sold in bulk quantities.

While blister pack packaging provides a convenient method of displaying a product in a retail store, blister packs present difficulties involved in either storing or shipping packaged products. These difficulties result from the uneven geometric configuration and the uneven weight distribution in blister packs. The uneven geometric configuration and the uneven weight distribution prevent convenient stacking of blister packs. In addition, large volumes of blister packs in a carton can lead to difficulties in accurately counting the number of blister packs. If the blister packs are packed loosely in a carton for shipment, there is oftentimes damage to both the card portion and the blister portion of the blister pack. Accordingly, there is a need in the art for a packaging system which provides an orderly arrangement of packaged products during storage, shipment, and retail presentation so as to avoid the problems associated with blister packs.

Prior-art approaches to providing an orderly arrangement of blister packs have included the use of a rack for hanging blister packs and a shelf for supporting freestanding packages. While, in some types of packages, vertical support of the freestanding package may be provided by folded panels of paperboard or external structures, in certain other types of packages the support is provided by the blister material, either by itself or in cooperation with the paperboard to which the blister is attached.

Certain prior-art vertically self-supporting blister pack display packages have been provided with a supporting structure integrally formed at the bottom of the blister pack. These supporting structures may include one or more bottom, flat surface(s) formed into the clear plastic blister material, wherein the surface or surfaces are sufficiently large to maintain the entire package in a vertical orientation. In packages of this type, the vertical orientation of the package is maintained independently of the paperboard back panel to which the clear plastic blister material is secured.

Supporting structures may take the form of one or more foot-type protrusion(s) of the blister material. This construction provides vertical support through cooperative action between the protrusion(s) and other parts of the package. Both the surface-support and foot-support type packages require additional blister material to form the necessary structure. This construction generally increases the complexity and cost of the packages.

Even in the relatively simple foot-support type packages, the supporting foot and the blister material connected to the body of the package must be relatively thick to be strong enough to support the weight of certain products. For products above a certain weight, foot-support type packages have proven to be unsatisfactory. Additionally, because of the inherent downwardly directed angle of the foot relative to the base of the blister pack in some packages, some blister packs do not easily lend themselves to automated display package assembly. Additionally, if the vertical orientation is to be maintained by the cooperative action of the foot and the paperboard back, slight displacements in the positioning of the blister on the paperboard will result in non-vertical packages.

Accordingly, a problem remains in the art for a system that arranges product packages in an orderly manner for storage, shipment, and retail presentation.

SUMMARY

The present invention provides a system for the orderly arrangement of product packages during storage, shipment, and retail presentation.

According to a first embodiment of the present invention, a first product to be packaged according to the present invention has a generally cylindrical lower portion and a truncated conical upper portion. A first accessory package is disposed beneath the generally cylindrical lower portion of the first product. The first accessory package incorporates a top side, a bottom side, and four vertical sides.

A first upper package shell is disposed around the first product. A first upper package shell incorporates a generally flat upper surface and a truncated generally conical intermediate surface disposed around the upper surface. A generally cylindrical side surface has an upper end extending downward from the intermediate surface to a lower end. An upper generally horizontal surface has an inner portion extending outward from the lower end of the generally cylindrical side surface to an outer portion.

The first upper package shell includes four vertical side surfaces. Each of the vertical side surfaces has an upper edge extending downward from the outer portion of the upper generally horizontal surface to a lower edge.

A first lower package shell is disposed beneath the first product accessory package. The first lower package shell has an upper surface facing the bottom side of the first product accessory package, a lower surface facing away from the lower side of the first product accessory package, and outer edges adjacent to the lower edges of vertical side surfaces of the first upper package shell.

According to a second embodiment, the present invention includes a product and package assembly, including both a first product having a generally cylindrical lower portion and a truncated conical upper portion and a second product, disposed adjacent to the first packaged product, also having a generally cylindrical lower portion and a truncated conical upper portion.

A product accessory package, having a top side, a bottom side, and at least one vertical side, is disposed beneath the cylindrical lower portions of the first and second packaged products. An upper package shell, disposed around the first and second packaged products, includes a set of shapes integrally formed to conform to the profile of the packaged products. Each shape includes at least one generally flat upper surface, at least one truncated generally conical intermediate surface disposed around the upper surface, at least one side surface having at least one generally cylindrical portion having an upper end extending downward from the intermediate truncated conical surface and a lower end.

The upper package shell includes an upper generally horizontal surface having an inner portion extending outward from the lower ends of the generally cylindrical portions of the side surfaces of the protruding shapes to an outer portion. The upper package shell includes at least one vertical side surface, each vertical side surface having an upper edge extending downward from the outer portion of the upper generally horizontal surface to a lower edge.

A lower package shell is disposed beneath the accessory package. The lower package shell has an upper surface facing the lower side of the product accessory package, a lower surface facing away from the lower side of the product accessory package, and an outer edge. The outer edge intersects with the lower edge of the vertical side surface of the upper package shell.

According to a third embodiment, the present invention includes a product and package assembly, including at least two products, each product having a generally cylindrical lower portion and a truncated conical upper portion. A generally rectangular product accessory package is disposed underneath the packaged products. An upper package shell is disposed around the first and second packaged products and the product accessory package. The upper package shell incorporates a set of generally planar upper surfaces, each disposed above a product. A set of partially conical intermediate surfaces and partially cylindrical side surfaces extend down around the packaged products to a horizontal surface atop the product accessory package. Planar vertical surfaces span between the partially cylindrical surfaces in order to improve the structural integrity of the upper package shell.

At its lower edge, the upper package is connected to a generally flat lower package shell.

BRIEF DESCRIPTION OF THE DRAWING FIGURES

A better understanding of the high-visibility product and package system of the present invention may be had by reference to the drawings wherein.

DETAILED DESCRIPTION OF THE DRAWINGS

Figure 1:
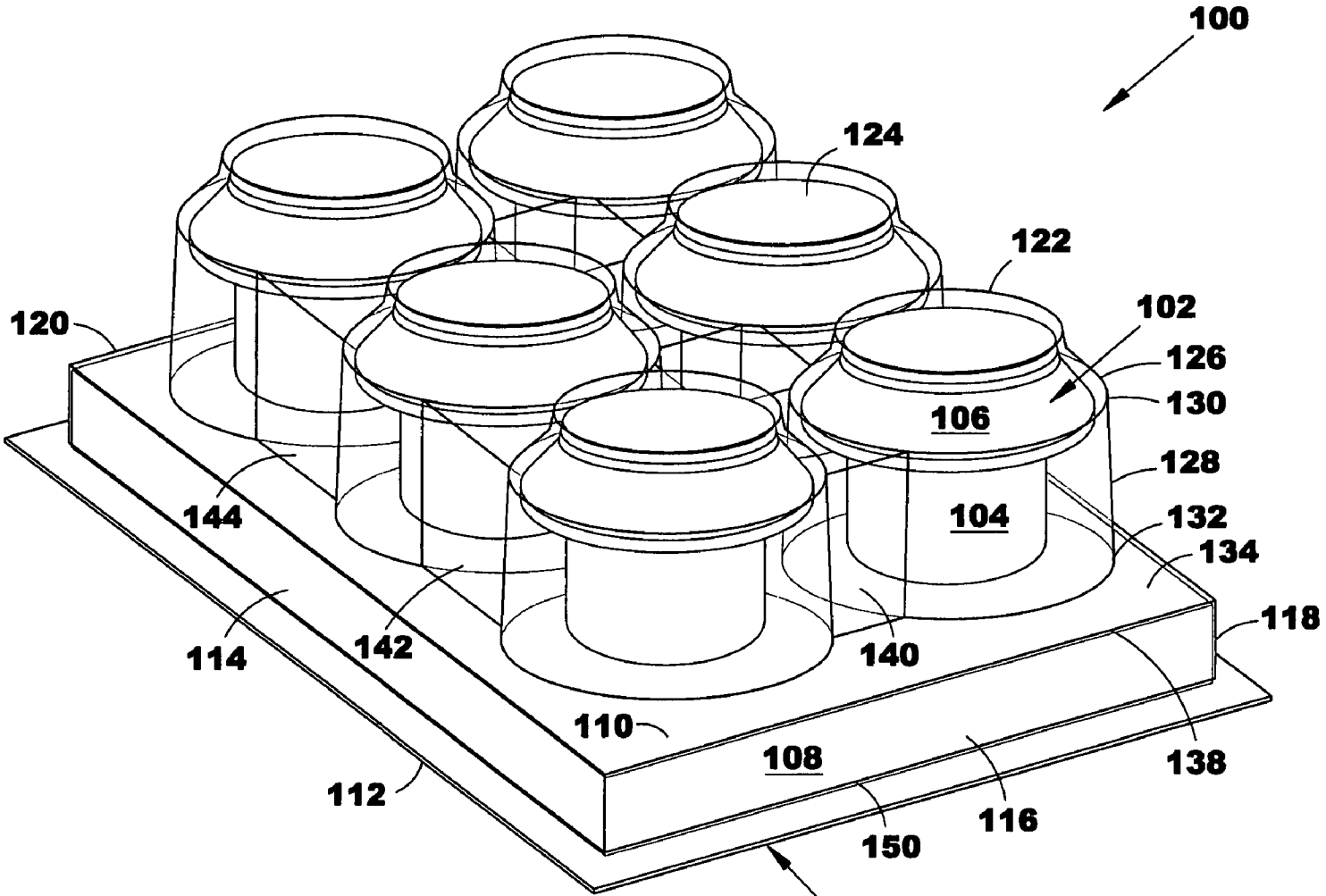
FIG. 1 is an isometric view of a first embodiment of the present invention.
Figure 2:
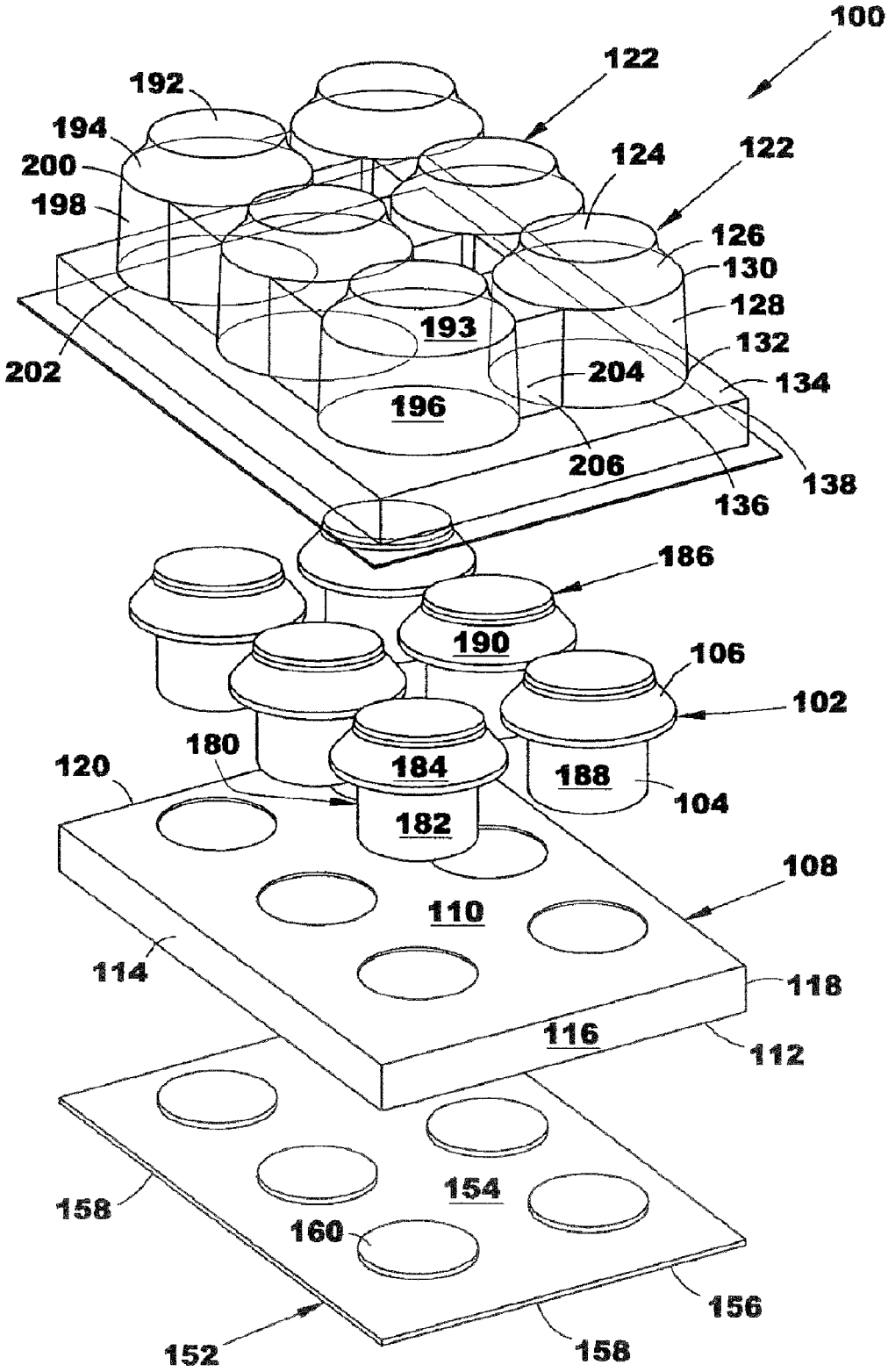
FIG. 2 is an exploded isometric view of the embodiment shown in FIG. 1.
Figure 3:
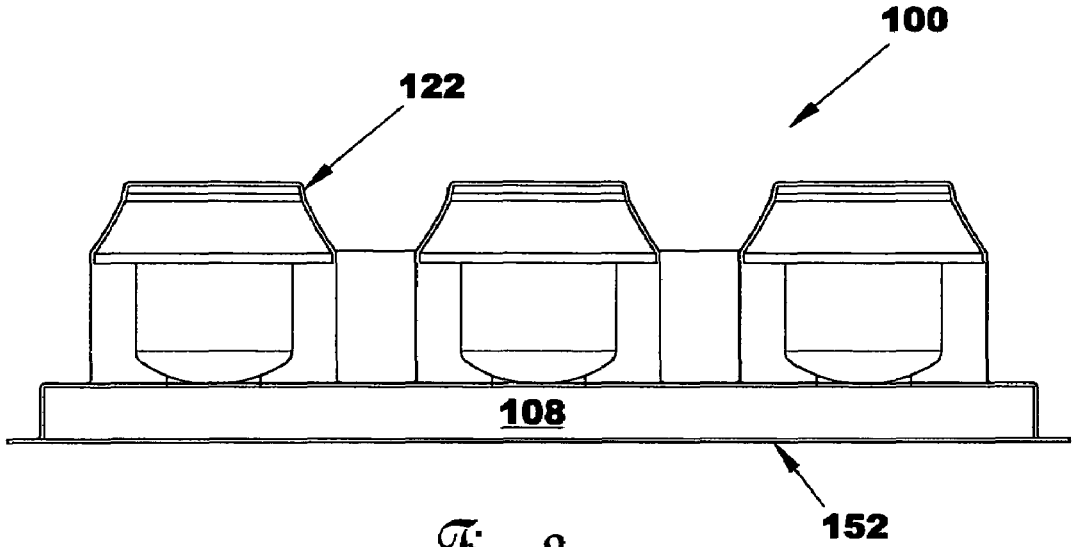
FIG. 3 is a front view of the embodiment shown in FIG. 1.
Figure 4:
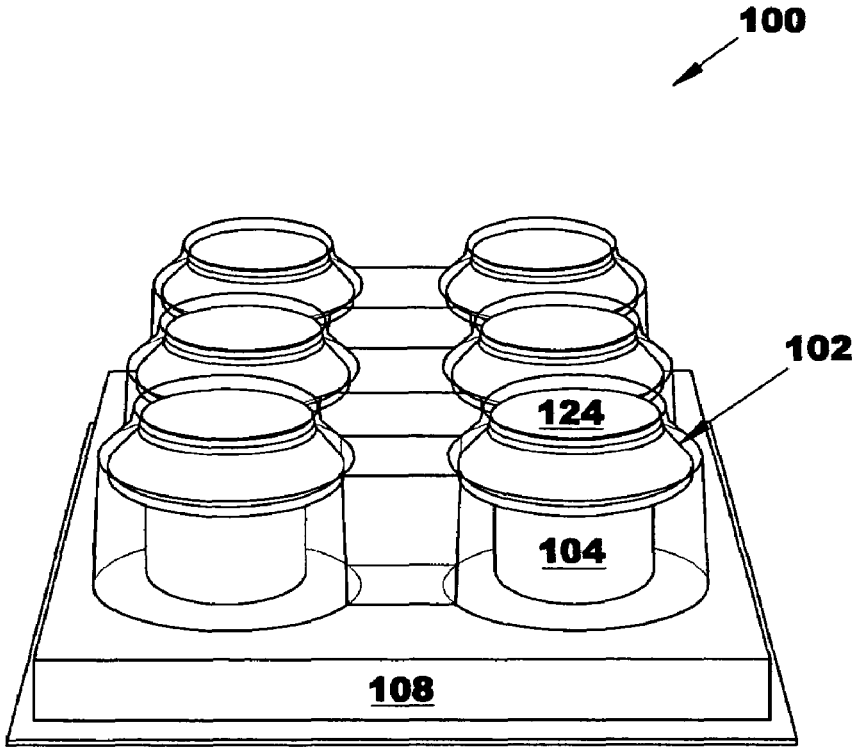
FIG. 4 is a right side perspective view of the embodiment shown in FIG. 1.
Figure 5:
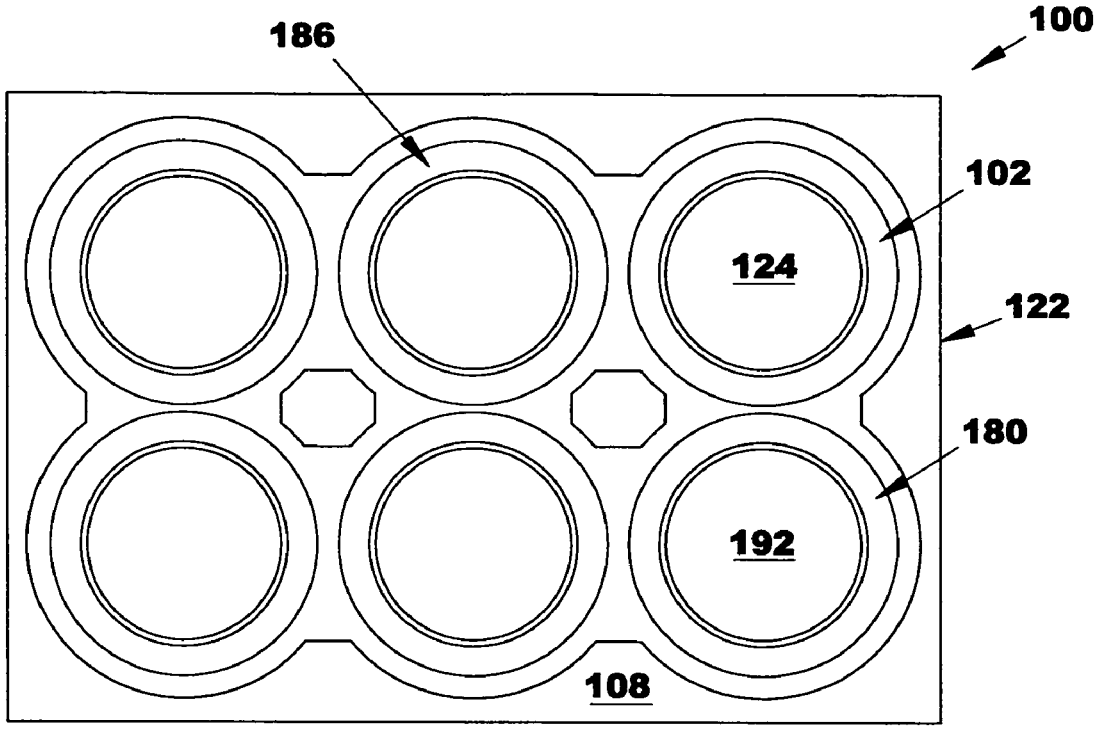
FIG. 5 is a top view of the embodiment shown in FIG. 1.

FIGS. 1, 2, 3, and 4 illustrate a product and package assembly 100 according to a first embodiment of the present invention. A first product 102 has a generally cylindrical lower portion 104 and a truncated conical upper portion 106. A first product accessory package 108 is disposed beneath the generally cylindrical lower portion 104 of the first product 102. The first product accessory package 108 incorporates a top side 110, a bottom side 112, and four vertical sides 114, 116, 118, and 120.

A first upper package shell 122 is disposed around the first product 102. In the preferred embodiment, shell 122 is formed from a translucent clear plastic. Alternatively, the shell 122 may be formed from a transparent plastic. The first upper package shell 122 incorporates a generally flat upper surface 124 and a truncated generally conical intermediate surface 126 disposed around the upper surface 124. A generally cylindrical side surface 128 has an upper end 130 extending downward from the intermediate surface 126 to a lower end 132. An upper generally horizontal surface 134 has an inner portion 136 extending outward from the lower end 132 of the generally cylindrical side surface 128 to an outer portion 138. The first upper package shell 122 also includes a set of vertical side surfaces, including side surfaces 140, 142, and 144.

A first lower package shell 152 is disposed beneath the first product accessory package 108. The shell 152 has an upper surface 154 facing the bottom side 112 of the first product accessory package 108, a lower surface 156 facing away from the lower side of the first product accessory package 108, and outer edges 158 adjacent to the lower edges 150 of the lower vertical side surfaces of the first upper package shell 122. In the embodiment shown in FIGS. 1-5, first lower package shell 152 incorporates a set of substantially cylindrical pockets 160 shaped and sized to receive the upper portions of the upper package shell 122. Alternatively, the substantially cylindrical pockets may have a perimeter characterized by substantially straight portions, substantially arcuate portions, or any combination thereof.

A second product 180, having a generally cylindrical lower portion 182 and a truncated conical upper portion 184, is disposed adjacent to the first product 102. A third product 186, having a generally cylindrical lower portion 188 and a truncated conical upper portion 190, is disposed adjacent to the first product 102 and second product 180.

A second generally planar upper surface 192 of the package shell 122 is disposed above the second product 180. A second intermediate surface 193, having a truncated generally conical portion 194, is disposed around the second upper surface 192. A second side surface 196 has a generally cylindrical portion 198, having an upper end 200 extending downward from the second intermediate surface 193 to a lower end 202. A third side surface 204 has a generally planar portion 206 extending from the generally cylindrical first side surface 128 to the second side surface 196.

Figure 6:
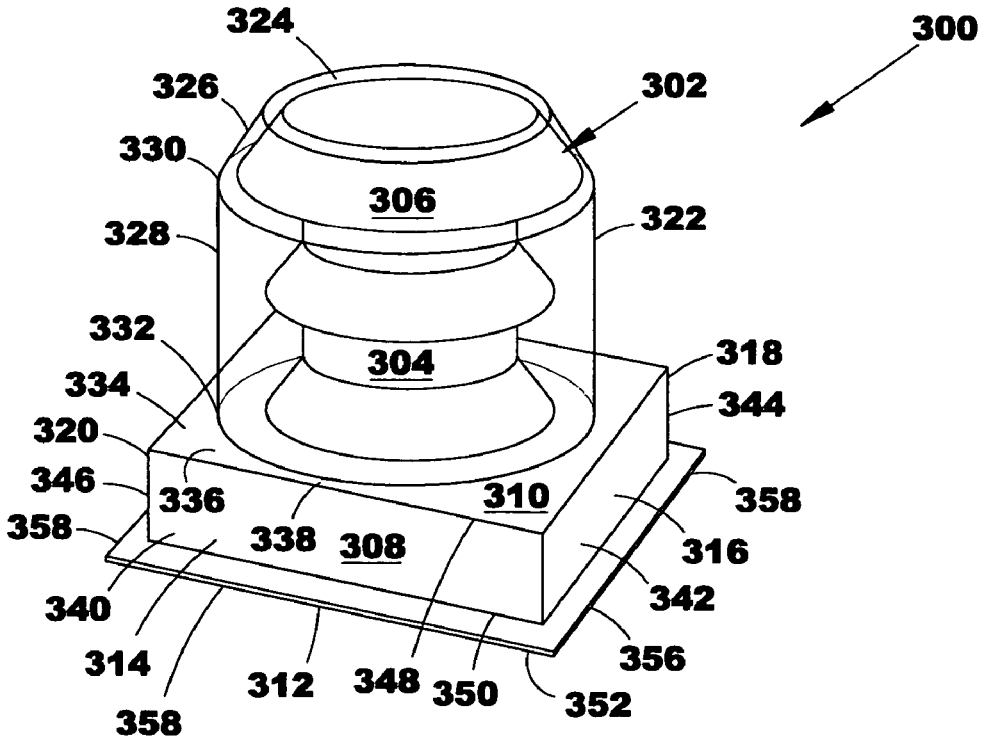
FIG. 6 is a perspective view of a second embodiment of the present invention.
Figure 7:
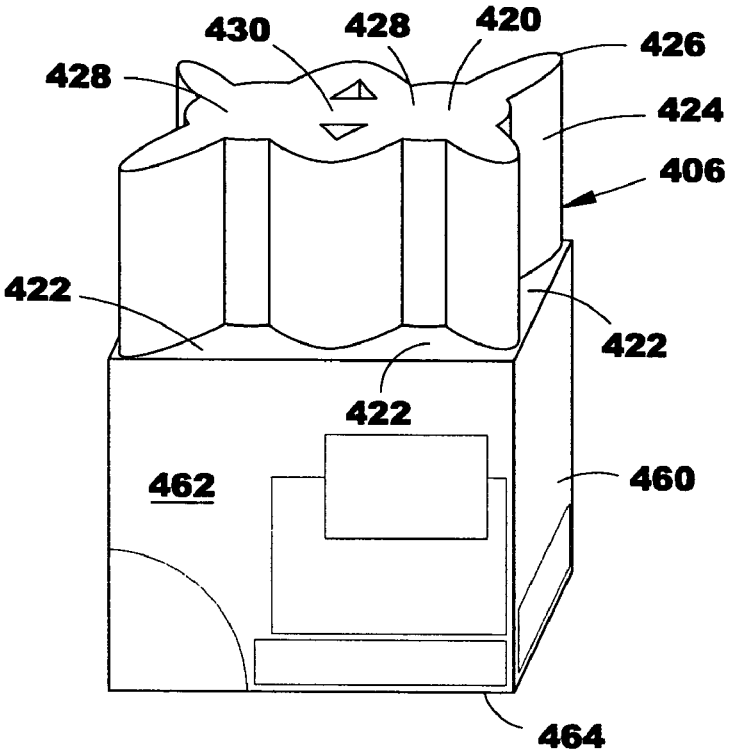
FIG. 7 is a perspective of a third embodiment.
Figure 8:
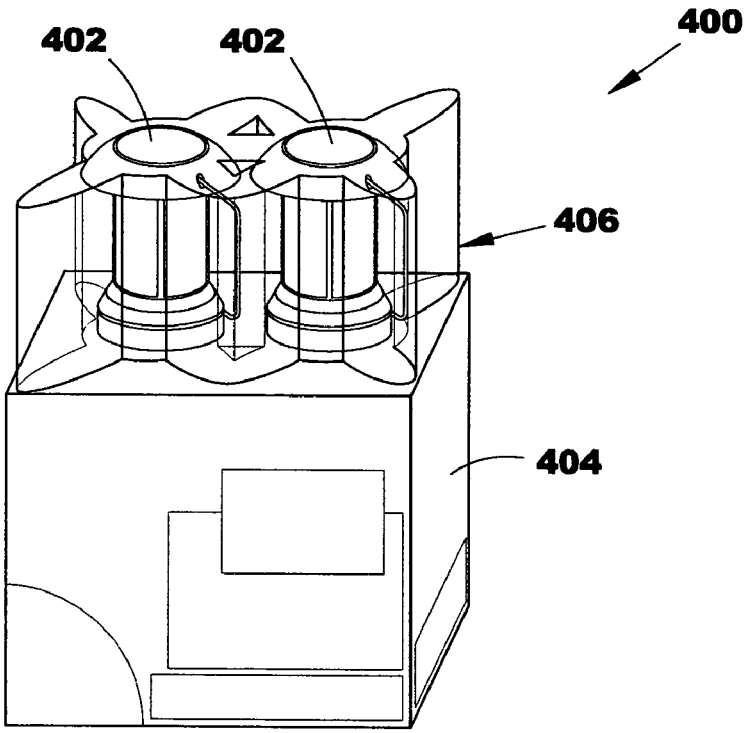
FIG. 8 is a perspective view similar to FIG. 7, including a packaged product.

FIG. 6 presents an isometric view of a product and package assembly 300 according to a second embodiment of the present invention. A first product 302 has a generally cylindrical lower portion 304 and a truncated conical upper portion 306. A first product accessory package 308 is disposed beneath the generally cylindrical lower portion 304 of the first product 302. The first product accessory package 308 incorporates a top side 310, a bottom side 312, and four vertical sides 314, 316, 318, and 320.

A first upper package shell 322 is disposed around the first product 302. First upper package shell 322 incorporates a generally flat upper surface 324 and a truncated generally conical intermediate surface 326 disposed around the generally flat upper surface 324. A generally cylindrical side surface 328 has an upper end 330 extending downward from the intermediate surface 326 to a lower end 332. An upper generally horizontal surface 334 has an inner portion 336 extending outward from the lower end 332 of the generally cylindrical side surface 328 to an outer portion 338.

The first upper package shell 322 includes four vertical side surfaces 340, 342, 344, and 346. Each of the vertical side surfaces 340, 342, 344, and 346 has an upper edge 348 extending downward from the outer portion 338 of the upper generally horizontal surface 334 to a lower edge 350.

A first lower package shell 352 is disposed beneath the first product accessory package 308, having an upper surface facing the bottom side of the first accessory package 308, a lower surface 356 facing away from the lower side of the first product accessory package 308, and outer edges 358 adjacent to the lower edges 350 of vertical side surfaces 340, 342, 344, and 346 of the first upper package shell 322.

FIGS. 7, 8, 9, and 10 depict a third embodiment of the present invention. In this additional embodiment, designated product and package assembly 400, one or more packaged products 402 are disposed atop a product box 404 within a package shell 406. Product box 404 may have promotional images and/or text printed thereon in order to identify the product and/or the product manufacturer, or to provide information about the packaged products 402 to potential purchasers.

In the embodiment shown in FIGS. 7, 8, 9, and 10, the packaged products 402 depicted are lamps, although alternate embodiments may employ any products having a suitable shape and size. The profile of package shell 406 may vary from one product to another in order to securely capture the packaged product 402. Depending on the application, the package shell 406 may be opaque, translucent, or transparent, or any combination thereof, and may be any color or pattern of colors.

The product box 404 may have an elongated rectangular box shape, as shown, or may have a cubic shape, or any other shape providing surfaces upon which promotional information may be displayed. In various embodiments, the product box 404 may contain additional packaged products 402 or product accessories (not shown), or may be empty. In certain embodiments, the product box 404 may be empty, and may be shaped to include a cavity in the bottom thereof, so as to nest around the top portion of a similar product and package assembly 400 disposed thereunder.

The package shell 406 has an inner profile shaped to conform to the outer profile of the packaged product 402. The package shell 406 has a generally horizontal upper surface 420 disposed atop the packaged products 402 and a set of generally horizontal intermediate surfaces 422 disposed near the bottom of the products 402. Substantially vertical walls 424 extend down from the outer edges 426 of upper surface 420 to the intermediate surfaces 422. In the embodiment shown in FIGS. 7, 8, 9, and 10, the upper surface 420 of package shell 406 has the general appearance of two "X"-shaped cavities 428 connected by a bridge 430.

Figure 9:
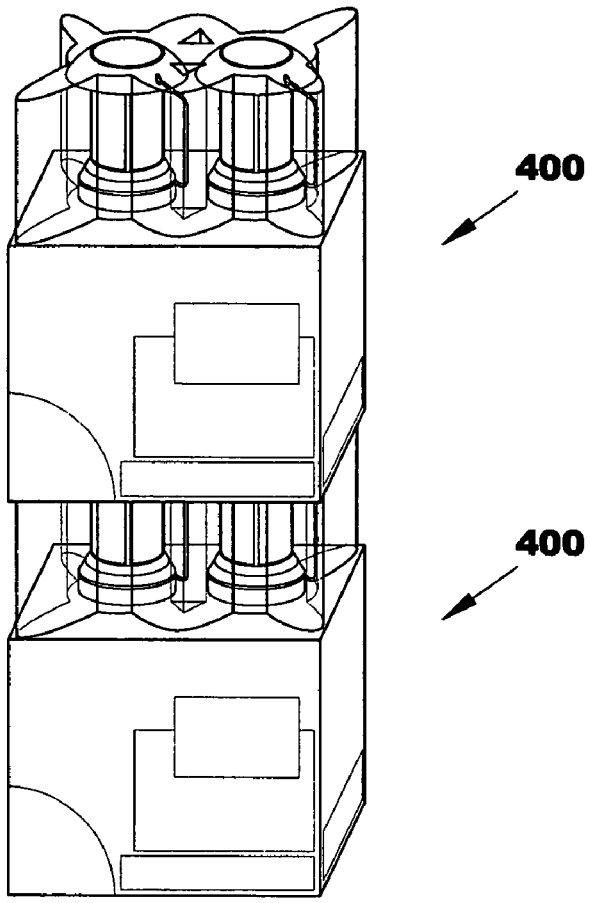
FIG. 9 is a perspective view of stacked packages according to the third embodiment.
Figure 10:
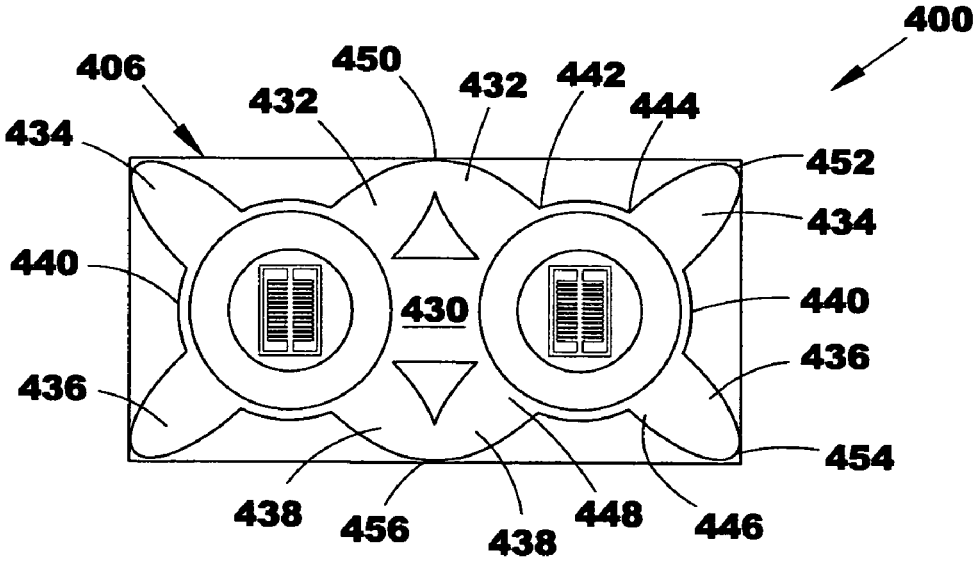
FIG. 10 is a top view of the third embodiment.

Within each of the two cavities 428, a set of protrusions 432, 434, 346, and 438 extends away from a central hub 440. The central hub 440 may be generally cylindrical or generally conical, as examples, but may have other shapes as desired. Each of protrusions 432, 434, 436, and 438 extends from the central hub 440 to a corner or edge of the package shell 406. Viewed from the top, each of the protrusions 432, 434, 436, and 438 is broad at its base 442, 444, 446, and 448 and narrow at its tip 450, 452, 454, and 456. Taken together, the upper surface 420 of the two cavities 428 forms a platform upon which one or more additional assemblies 400 may be stacked in a stable arrangement, as shown in FIG. 9.

A set of lower, generally vertical surfaces, including walls 460 and 462, is disposed about the product box 404. Each surface extends downward from the outer edge of one of the intermediate surfaces 422 to the base of the package assembly 400. The bottom end of package shell 406 may be closed off with a flat or three-dimensional lower shell 464, which may be shaped to conform to the upper surface 420 of package shell 406 in order to enhance stability.

While the disclosed invention has been described according to its preferred and alternate embodiments, those of ordinary skill in the art will understand that other embodiments of the disclosed invention have now been enabled. Such other embodiments shall fall within the scope and meaning of the appended claims.

What is claimed is:

1. A product and package system comprising:

a first product having a generally cylindrical lower portion and a truncated conical upper portion;

a first product accessory package having a top side, a bottom side, and at least one vertical side, disposed beneath the cylindrical lower portion of the product;

a first upper package shell, disposed around said first product, having a generally flat upper surface, a truncated generally conical intermediate surface disposed around said upper surface, a generally cylindrical side surface having an upper end extending downward from said intermediate surface and a lower end, an upper generally horizontal surface having an inner portion extending outwardly from said lower end of the generally cylindrical side surface, and an outer portion and at least one vertical side surface, each vertical side surface having an upper edge extending downward from the outer portion of said upper generally horizontal surface to a lower edge; and a first lower package shell disposed beneath said first upper package shell, having an upper surface facing the lower side of said first accessory package, a lower surface facing away from the lower side of said first accessory package, and at least one outer edge adjacent to at least one lower edge of a vertical side surface of said first upper package shell, wherein the lower surface of said first lower package shell comprises at least one mating feature shaped to receive an upper portion of a second upper package shell.

2. The product and package system, as defined in claim 1, further including a second product within said first upper package shell.

3. The product and package system, as defined in claim 1, wherein said first upper package shell is translucent.

4. The product and package system, as defined in claim 1, wherein said first upper package shell is transparent.

5. The product and package system, as defined in claim 1, further including a second product disposed within said second upper package shell, disposed beneath said first lower package shell.

6. The product and package system, as defined in claim 1, wherein the mating feature is a cylindrical pocket.

7. The product and package system, as defined in claim 1, wherein the mating feature is a rectangular pocket.

8. A product and package system comprising:

a first product having a generally cylindrical lower portion and a truncated conical upper portion;

a second product, disposed adjacent to said first product, having a generally cylindrical lower portion and a truncated conical upper portion;

a product accessory package having a top side, a bottom side, and at least one vertical side, disposed beneath said cylindrical lower portions of said first and second products;

a first upper package shell, disposed around said first and second products, having at least one generally flat upper surface, at least one truncated generally conical intermediate surface disposed around said upper surface, at least one side surface having at least one generally cylindrical portion having an upper end extending downward from said intermediate truncated conical surface and a lower end and at least one generally planar portion, an upper generally horizontal surface having an inner portion extending outward from said lower end of the generally cylindrical portion of a side surface and an outer portion and at least one vertical side surface, each vertical side surface having an upper edge extending downward from said outer portion of the upper generally horizontal surface to a lower edge; and a first lower package shell disposed beneath said product accessory package, having an upper surface facing said lower side of said product accessory package, a lower surface facing away from the lower side of said product accessory package, and at least one outer edge adjacent to at least one lower edge of a vertical side surface of said first upper package shell, wherein said lower surface of said first lower package shell comprises at least one mating feature shaped to receive an upper portion of a second upper package shell.

9. The product and package system, as defined in claim 8, further including a third product disposed within said first upper package shell.

10. The product and package system, as defined in claim 8, wherein said first upper package shell is translucent.

11. The product and package system, as defined in claim 8, wherein said first upper package shell is transparent.

12. The product and package system, as defined in claim 8, further including a third product, disposed within said second upper package shell, disposed beneath said first lower package shell.

13. The product and package system, as defined in claim 8, wherein the mating feature is a cylindrical pocket.

14. The product and package, as defined in claim 8, wherein the mating feature is a rectangular pocket.

15. A product and package system comprising:

a first product having a generally cylindrical lower portion and a truncated conical upper portion;

a second product, disposed adjacent to said first product, having a generally cylindrical lower portion and a truncated conical upper portion;

a product accessory package having a top side, a bottom side, and at least one vertical side, disposed beneath said cylindrical lower portions of said first and second products;

an upper package shell disposed around said first and second products, having: a first generally planar upper surface disposed above said first product, a second generally planar upper surface disposed above said second product, a first intermediate surface having a truncated generally conical portion disposed around said first upper surface, a second intermediate surface having a truncated generally conical portion disposed around said second upper surface, a first side surface having at least one generally cylindrical portion having an upper end extending downward from said first intermediate surface and a lower end, a second side surface having at least one generally cylindrical portion having an upper end extending downward from said second intermediate surface and a lower end, a third side surface having a generally planar portion extending from said first side surface to said second side surface, an upper generally horizontal surface intersecting said first, second, and third side surfaces and having an outer edge;

and at least one vertical side surface, each vertical side surface having an upper edge extending downward from said outer portion of said upper generally horizontal surface to a lower edge; and a lower package shell, disposed beneath said product accessory package, having an upper surface facing the lower side of the accessory package, a lower surface facing away from said lower side of the accessory package, and at least one outer edge adjacent to at least one lower edge of a vertical side surface of said upper package shell.

16. The product and package system, as defined in claim 15, further including a third product disposed within the first upper package shell.

17. The product and package system, as defined in claim 15, wherein said first upper package shell is translucent.

18. The product and package system, as defined in claim 15, wherein the first upper package shell is transparent.

19. The product and package system, as defined in claim 15, further including a third product disposed within a second upper package shell, disposed beneath said first lower package shell, and wherein said lower surface of the first lower package shell includes at least one mating feature shaped to receive an upper portion of said second upper package shell.

20. The product and package system, as defined in claim 19, wherein said mating feature is a cylindrical pocket.

* * * * *